US007029367B2

(12) United States Patent
Bouillot et al.

(10) Patent No.: US 7,029,367 B2
(45) Date of Patent: Apr. 18, 2006

(54) AUTOMATED POLISHING PROCESS FOR MECHANICAL PARTS IN TITANIUM OR TITANIUM ALLOY

(75) Inventors: Bertrand Bouillot, Paris (FR); Alain Keller, Dieudonne (FR); Daniel Langeard, Herblay (FR); Alain Martinez, Corbeil (FR); Giao-Minh Nguyen, Courbevoie (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/963,571

(22) Filed: Oct. 14, 2004

(65) Prior Publication Data

US 2005/0136799 A1 Jun. 23, 2005

(30) Foreign Application Priority Data

Oct. 14, 2003 (FR) ..... 03 12005

(51) Int. Cl.
*B24B 49/00* (2006.01)

(52) U.S. Cl. ..... 451/5; 451/59

(58) Field of Classification Search ..... 451/5, 451/11, 59, 296
See application file for complete search history.

(56) References Cited

U.S. PATENT DOCUMENTS

| | | | | |
|---|---|---|---|---|
| 4,718,197 | A * | 1/1988 | Rath | 451/65 |
| 5,040,337 | A * | 8/1991 | Spirito et al. | 451/273 |
| 5,193,314 | A * | 3/1993 | Wormley et al. | 451/5 |
| 6,277,160 | B1 * | 8/2001 | Stubbs et al. | 51/295 |
| 6,280,288 | B1 | 8/2001 | Gaeta et al. | |
| 6,383,064 | B1 | 5/2002 | Eggert et al. | |
| 2003/0100242 | A1 * | 5/2003 | Annigeri et al. | 451/5 |
| 2003/0106270 | A1 * | 6/2003 | Baldoni et al. | 51/297 |
| 2004/0185754 | A1 * | 9/2004 | Adefris et al. | 451/28 |

FOREIGN PATENT DOCUMENTS

| | | |
|---|---|---|
| DE | 44 24 167 A1 | 1/1996 |
| EP | 0 263 785 | 4/1988 |
| WO | WO 98/05473 | 2/1998 |

* cited by examiner

*Primary Examiner*—Jacob K. Ackun, Jr.
(74) *Attorney, Agent, or Firm*—Oblon, Spivak, McClelland, Maier & Neustadt, P.C.

(57) ABSTRACT

The present invention pertains to an automated polishing process for semi-finished mechanical parts in titanium or titanium alloy, using a machine with abrasive belt mounted on a tangential contact wheel driven in rotation at a determined speed and applied at a determined pressure, the wheel travelling with respect to the part's surface at a determined rate, characterized by the fact that the abrasive belt consists of superabrasive grains in industrial diamond or cubic boron nitride. The process is applied to geometric conforming of jet engine fan or compressor blades.

21 Claims, 2 Drawing Sheets

Figure 1:
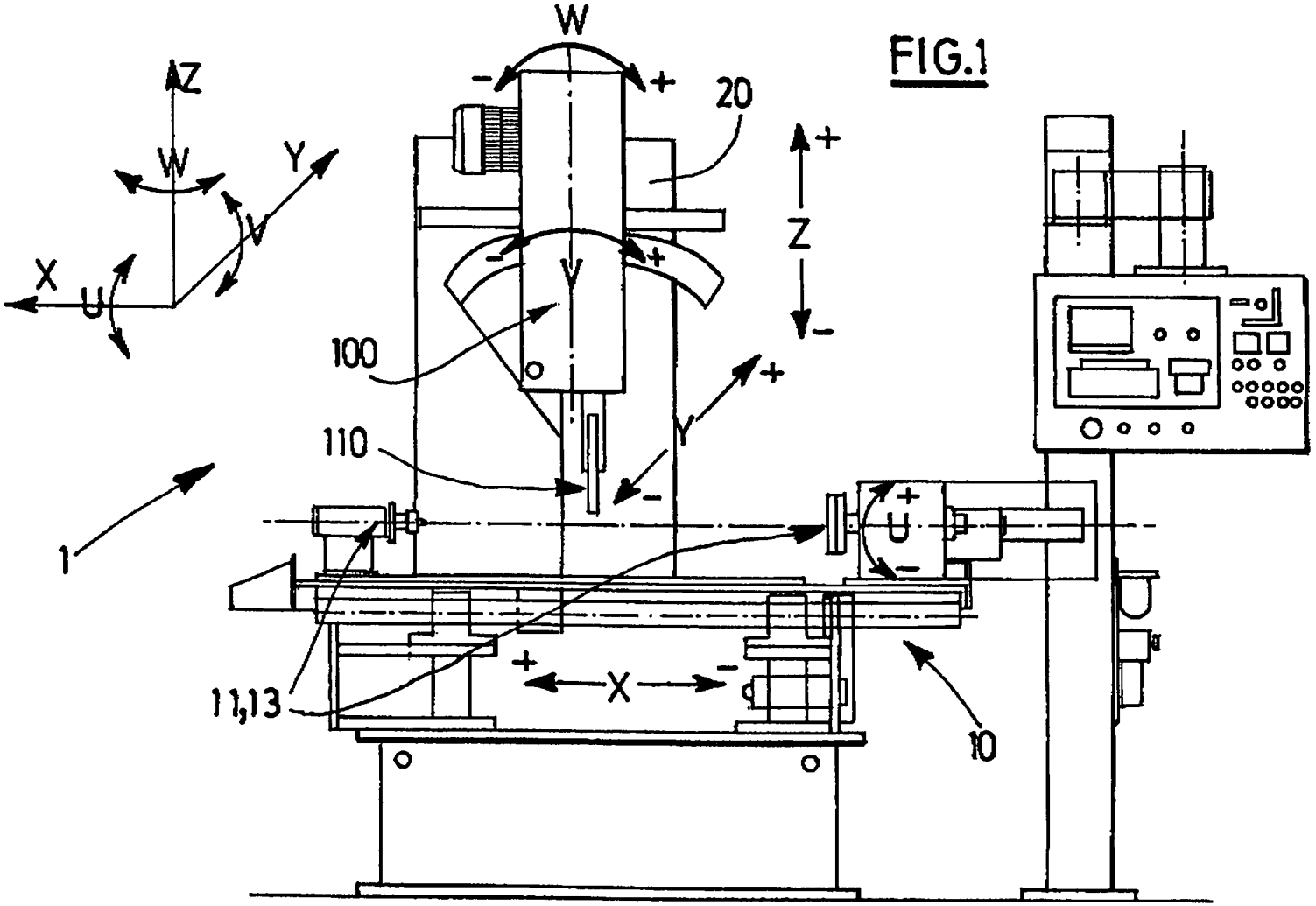

10
20
100
110
11,13
1
Z
W
X
Y
U
V

AUTOMATED POLISHING PROCESS FOR MECHANICAL PARTS IN TITANIUM OR TITANIUM ALLOY

The area of the present invention is the polishing of mechanical parts in titanium or titanium alloy. The invention particularly concerns turbomachine blades, especially large-size blades such as fan blades for jet engines, and pertains in particular to a process for fabricating such blades using said polishing.

For the polishing of mechanical parts, low cost abrasive materials are generally sought which are stress-resistant and generate little pollution. In this area, pollution consists of grains of abrasive material which become trapped within the bulk of the part. For jet engine blades in titanium or titanium alloy, it is essential to prevent this pollution.

Conventionally, for blade polishing, abrasive belts of silicon carbide are used. The belt is mounted on a wheel driven in rotation tangentially to the surface of the workpiece. The wheel's movement relative to the surface of the workpiece is piloted by a programme in accordance with desired geometry. Parameters such as the travel speed of the belt over the surface, wheel velocity with respect to the workpiece and the pressure exerted on the surface are determined so as to remove the desired thickness of material and to ensure a certain surface condition. A description of a polishing machine using abrasive belts can be found in patent U.S. Pat. No. 5,193,314.

However, this material is not fully satisfactory.

The belts wear rapidly. In the case of jet engine fan blades for example, two belts are consumed per workpiece to achieve geometric conformity from a semi-finished blank.

The abrasive material pollutes the titanium. Precautions need to be taken for its avoidance.

The depositing of the abrasive on commercially available belts is generally made by electrostatic means. The regularity of deposit is not optimum. It leads to some dispersion in terms of material removal. Polishing is not homogeneous. It is subsequently necessary to conduct manual rework to remove material, possibly associated with thickness readjustment.

Abrasive belt polishing is used in particular for achieving the geometric conformity of semi-finished blades produced by forging for example. A determined thickness of material is removed by polishing. With conventional abrasive material, however, an insufficient quantity of material is removed by the wheel and its abrasive belt, and additional operations are required to remove material and to control thickness. Therefore, to achieve the geometric conformity of a semi-finished forged blade, the process includes chemical machining before polishing. After the part has been polished a first time with a determined grain size, it must then undergo chemical machining and manual rework on electric straight grinding wheels or on brushing wheels or other portable machine.

The present invention sets out to overcome the disadvantages encountered with prior art abrasive belts.

According to the invention, the automated polishing process for semi-finished mechanical parts in titanium or titanium alloy, using a machine with abrasive belt mounted on a tangential contact wheel driven in rotation at determined velocity and applied under determined pressure, the wheel travelling with respect to the surface of the part at a determined rate, is characterized by the fact that the abrasive belt consists of superabrasive grains in industrial diamond or cubic boron nitride.

After testing, it was surprisingly found that the use of belts of this type made it possible to overcome the problems raised by conventional abrasive belts.

The abrasive layer of the belt is more precise. With diamond for example, the belt is formed by more homogeneous electrochemical deposit. The superabrasive grains are backed by a layer of nickel which itself is integral with a polyester base. The nickel layer absorbs the heat and prevents work hardening of the part.

On account of the greater precision of the belt's abrasive layer, the quantities of material are removed with very low thickness dispersion. This low dispersion provides a major advantage for achieving geometric conformity of blades made from semi-finished parts having a determined allowance. The difference in the extent of material removal with respect to a set dimension is sufficiently small to remain within the tolerance range for blade shape. There is therefore no need to conduct further manual adjustments by grinding.

In particular, for blade polishing, when it is required to reduce a determined allowance subsisting after forging or machining of the part, the machine parameters are set at the following intervals:

Wheel application force on the workpiece surface: 137 N to 196 N

Pass speed of the belt: 4.6 m/s to 18.6 m/s

Range of wheel travel speed relative to the workpiece: 3.4 m/min to 6.7 m/min.

The thickness allowance lies between 2/10 and 4/10 mm.

Advantageously, the contact wheel is grooved, having grooves arranged obliquely with respect to the axis of rotation of the wheel. In particular, the angle is 25 to 35°.

More particularly, the contact surface of the wheel with the abrasive belt has a hardness of 70 Shore.

Figure 2:
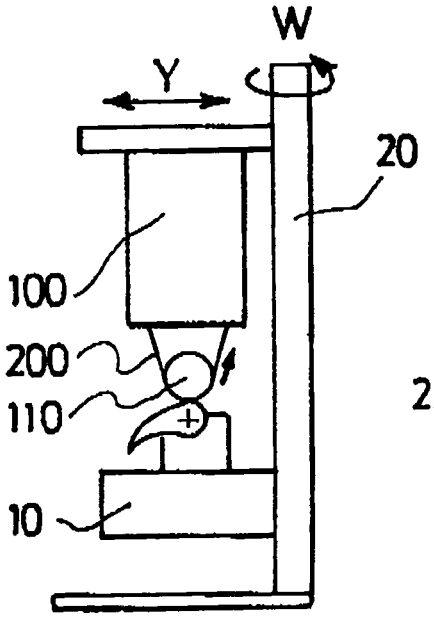
Figure 3:
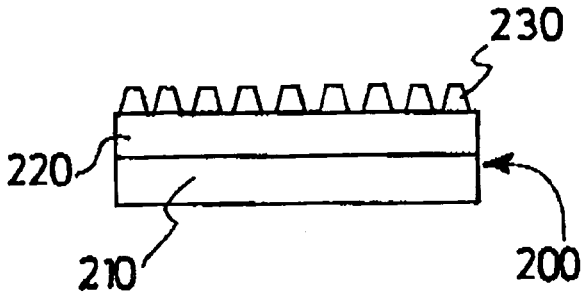

The invention is described below in more detail with reference to a non-restrictive embodiment and referring to the appended drawings in which:

FIG. 1 is a schematic of a polishing machine for implementing the process of the invention, FIG. 2 is a side view of the machine in FIG. 1, FIG. 3 is a section view of the belt used for the invention.

The machine has five or six degrees of freedom. An example of embodiment 1 is shown FIG. 1. It is for example a commercially available machine made by Metabo. A table 10 can be seen with two jaws 11 and 13 between which the workpiece of elongated shape such as a compressor blade is held horizontally. The workpiece with its support can be moved in direction X or rotate about itself around this axis in direction U by means of appropriate electric motors Mx and Mu. Above the table, a head 100 is mounted on a vertical pylon 20 and can move along its axis Z. Head 100 may also move in rotation W about this axis Z. Appropriate motors Mz and Mw are provided to drive the head in these two directions. Finally, head 100 is able to move horizontally in direction Y perpendicular to direction X and to pivot in direction V about this axis. Motor means My and Mv ensure these movements. Head 100 carries a contact wheel 110 mobile about an axis which is fixed with respect to itself. A motor mounted on head 100 ensures driving of the wheel 110 via an abrasive belt mounted on the periphery of the wheel.

All the motor means are connected to a transmitter which comprises a command unit with programming means and memories for storage in particular of the geometric data of the part to be polished.

To polish the part, the belt is applied locally, tangential to its surface, by exerting a determined pressure and it is set in movement. It rotates with the wheel about its axis.

The desired thickness removal and surface condition depend both upon the grain size of the belt and on applied machine parameters and the characteristics of the contact wheel.

The parameters of a machine so configured are:

the force (N) exerted by the contact wheel on the workpiece, the relative travel speed of the belt along the axis of the workpiece, here axis X, the pass speed of the belt (m/s) on the workpiece in the direction of wheel rotation.

These parameters are determined for a defined wheel, both geometrically and according to the quality of its constituent material. For example, a wheel is used of determined width 25 mm, with determined outer diameter 120 mm. On its surface the wheel comprises grooves inclined at 30°, of width 3 mm and distanced apart by 17 mm. The material on the wheel's periphery is rubber having a hardness of 70 shore for example.

Said machine is used for geometric conforming operations and for finishing a semi-finished part by polishing.

These operations comprise a certain number of steps which are described below. The shape and size characteristics of the semi-finished part arriving from the forging station are close to those of the finished part. However, its dimensions are not yet final on account of a determined allowance. In precision forging, this allowance is fixed at 2/10 to 4/10 mm. The purpose of the automated polishing process is to remove this allowance.

Before polishing, the semi-finished part has to be prepared.

First, so-called tri-thickness control is conducted to verify the dimensions of the part and, if required, the surface parts of insufficient thickness are masked. This thickness readjustment may be achieved by applying an adhesive tape.

The following preparation step consists of chemical machining. This involves the chemical dissolution of the titanium alloys in a bath consisting of nitric acid, hydrofluoric acid and other agents such as wetting agents or water. The immersion time in the bath determines the quantity of removed material. The advantage of chemical machining is that a uniform thickness of material is removed irrespective of shape.

If necessary, these two operations are repeated until a determined allowance is obtained which is to be removed by the polishing operation.

The polishing operation, by passing the part through a machine fitted with an abrasive belt, is known in itself. A first so-called rough polishing is conducted.

Conventionally, a belt is used whose abrasive is silicon carbide having a grain size of 120 for example. The quantity of material removed is 0.25+/−0.1 mm.

Owing to the nature of the abrasive belt, the quantity dispersion of removed material is high.

A second control of the above-mentioned tri-thickness type is performed associated with chemical machining if necessary.

This control is followed by a manual adjustment step on a brushing wheel; this is a delicate operation and can only be performed by qualified personnel. If the blades are large-sized, these manual operations are the possible cause of occupational injuries such as repetitive strain injury (RSI).

Finish polishing is then conducted using a belt with finer grain size. However, on account of dispersion, removal values lie for example between 0.1 mm+/−0.05 mm. Final validation of geometry with manual rework may be necessary.

According to the invention, the belt used comprises superabrasive grains such as grains of industrial diamond or cubic boron nitride.

FIG. 3 is a schematic cross-section diagram of a belt 200 showing its structure; the backing 210 is in synthetic material that is polyester-based for example. On this backing, nickel grains 220 are attached. These grains themselves act as carrier for superabrasive particles such as industrial diamond or cubic boron nitride. Depositing is made by electrochemical process to ensure the formation of a homogeneous abrasive layer.

Said abrasive belts are available commercially from companies such as 3M, Saint Gobain Abrasives or KGS Owing to the homogeneity of its structure, this type of belt can remove material with low thickness dispersion. Accuracy may be in the order of 0.01 mm for a belt having a grain size of 220 (=74 μm).

The machine parameters were determined to remove a thickness of no more than 3/10 in one pass:

The range of pressure force exerted by the contact wheel on the part is 137 N to 196 N.

The range of table travel speed is 3.4 m/min to 6.7 m/min.

The pass speed range of the diamond abrasive belt is 4.6 m/s to 18.6 m/s.

The contact wheel used has the following characteristics:

Wheel of width 25 mm with an outer diameter adapted to the geometry of the workpiece.

Grooves defined to be sufficiently aggressive in terms of material removal.

Constituent material of the wheel adapted to the operation and of rubber type.

Once the semi-finished part has been prepared so that it comprises an allowance with respect to desired dimensions, that is accurately defined whether chemical machining is used or geometric conforming by manual rework (using carbide cutters for example on electric straight grinders) or a combination of both operations, a part having the desired dimensions is achieved directly after polishing with said belts. There is no need for manual adjustment operations between the two polishing operations, the so-called rough polishing and finish polishing. In remarkable manner, it is possible to remain within the shape tolerance laid down by specifications.

Rough polishing using a diamond belt of grain size 60 (=250 μm) removes a quantity of material of 0.3 mm+/−0.05 mm and ensures a surface condition of 1.8 μm.

Finish polishing using a diamond belt of grain size 220 (=74 μm) removes a quantity of material of 0.1 mm+/−0.01 mm and ensures a surface condition of 0.8 μm.

The final validation operation, which consists of dimension and appearance control, is possible without the use of a brushing wheel or portable polishing machine.

The scope of the invention also covers conducting the rough polishing by any known means such as chemical machining, manual polishing or any mechanical polishing, insofar as the finish polishing is performed using the polishing technique with diamond belt.

More generally, rough polishing is made on an allowance defined to allow material removal of between 0.1 mm and 0.8 mm, preferably between 0.2 mm and 0.4 mm and further preferably, as mentioned previously, of 0.3 mm+/−0.05 mm.

Finish polishing using the diamond belt with finer grain size, according to the invention, is performed to ensure material removal of between 0.01 and 0.2 mm+/−0.01 mm and preferably of 0.1 mm+/−0.01 mm.

The invention claimed is:

1. A process of manufacturing a mechanical part, said process comprising the following steps:

rough-polishing a semi finished part comprising titanium, wherein during said rough polishing, material between 0.1 mm and 0.8 mm thick is removed; and finish-polishing said rough-polished part, said finish-polishing being performed with an abrasive belt comprising super abrasive grains and mounted on a tangential contact wheel driven in rotation, wherein during said finish-polishing, material between 0.01 mm and 0.2 mm is removed.

2. The process of claim 1, further comprising a step of manufacturing said semi finished part having an allowance.

3. The process of claim 1, wherein said semi finished part is made of titanium and said material removed during said steps of rough-polishing and finish-polishing comprises titanium.

4. The process of claim 1, wherein said semi finished part is made of titanium alloy and said material removed during said steps of rough-polishing and finish-polishing comprises titanium alloy.

5. The process of claim 1, wherein said mechanical part is a fan blade.

6. The process of claim 5, wherein said fan blade is a jet engine blade.

7. The process of claim 1, wherein during said rough-polishing, material between 0.2 mm and 0.4 mm is removed.

8. The process according to claim 1, wherein the rough-polishing is performed by chemical machining.

9. The process according to claim 1, wherein the rough-polishing is performed by mechanical polishing with a super abrasive grains belt.

10. The process of claim 2, wherein said step of manufacturing said semi finished part comprises forging said semi finished part.

11. The process of claim 2, wherein said allowance is between 2/10 mm and 4/10 mm.

12. The process of claim 1, wherein said super abrasive grains comprise diamond.

13. The process of claim 1, wherein said super abrasive grains comprise cubic boron nitride.

14. The process of claim 1, wherein said abrasive belt comprises a layer of nickel that backs the super abrasive grains.

15. The process of claim 1, wherein said process is free of a step of manual adjustment by grinding.

16. The process of claim 1, wherein said finish-polishing is performed by applying a force on said rough-polished part, said force being between 137 N and 196 N.

17. The process of claim 1, wherein said finish-polishing is performed by moving said abrasive belt at a speed between 4.6 m/s and 18.6 m/s.

18. The process of claim 1, wherein said finish-polishing is performed by moving said wheel at a speed between 3.4 m/min and 6.7 m/mm.

19. The process of claim 1, wherein during said finish-polishing, material of 0.1 mm +/−0.01 mm is removed.

20. The process of claim 1, wherein during said rough-polishing, material of 0.3 mm +/−0.05 mm is removed.

21. The process of claim 1, wherein said super abrasive grains have a grain size of 220.

* * * * *